US006405986B1

(12) United States Patent
Swadling

(10) Patent No.: US 6,405,986 B1
(45) Date of Patent: Jun. 18, 2002

(54) MOUNTING ARRANGEMENT FOR A LOUDSPEAKER, LUMINAIRE OR SIMILAR APPARATUS

(75) Inventor: David John Swadling, Uxbridge (GB)

(73) Assignee: Martin Audio Limited, High Wycombe (GB)

( * ) Notice: Subject to any disclaimer, the term of this patent is extended or adjusted under 35 U.S.C. 154(b) by 0 days.

(21) Appl. No.: 09/236,887

(22) Filed: Jan. 26, 1999

(30) Foreign Application Priority Data

Jan. 26, 1998 (GB) ..... 98016801

(51) Int. Cl.[7] ..... B42F 13/00
(52) U.S. Cl. ..... 248/342; 181/150; 362/148
(58) Field of Search ..... 248/342, 343, 248/344, 320, 27.1, 27.3; 181/141, 150, 154; 362/365, 148

(56) References Cited

U.S. PATENT DOCUMENTS 3,159,234 A * 12/1964 Junk ..... 181/155
3,681,593 A * 8/1972 Genovese et al. ..... 439/237
3,859,480 A * 1/1975 Birkner et al. ..... 381/152
3,912,865 A * 10/1975 Seebinger ..... 248/343 X
4,380,099 A * 4/1983 Dick et al. ..... 403/329
4,546,850 A * 10/1985 Litner ..... 181/141
4,760,510 A * 7/1988 Lahti ..... 362/365
4,763,231 A * 8/1988 Houplain ..... 362/148
4,974,698 A * 12/1990 Smith ..... 181/150
4,997,059 A * 3/1991 See ..... 181/172
5,143,339 A * 9/1992 Ashcraft et al. ..... 248/343
5,725,302 A * 3/1998 Sirkin ..... 362/365
5,734,131 A * 3/1998 Sakamoto ..... 181/141
5,758,959 A * 6/1998 Sieczkowski ..... 362/365

FOREIGN PATENT DOCUMENTS

GB 2230591 10/1990

* cited by examiner

*Primary Examiner*—Anita King
(74) *Attorney, Agent, or Firm*—Hodgson Russ LLP

(57) ABSTRACT

A mounting arrangement for a loudspeaker, luminaire or similar apparatus, comprising a housing in which the apparatus is received and at least one resilient structure attached to the housing and to the apparatus, the length of the resilient structure between its points of attachment being such that when the apparatus is received in the housing the resilient structure is deformed and exerts a force retaining the apparatus in the housing, withdrawal of the apparatus from the housing requiring further deformation of the resilient means through a state of maximum deformation to a state of lesser deformation.

20 Claims, 1 Drawing Sheet

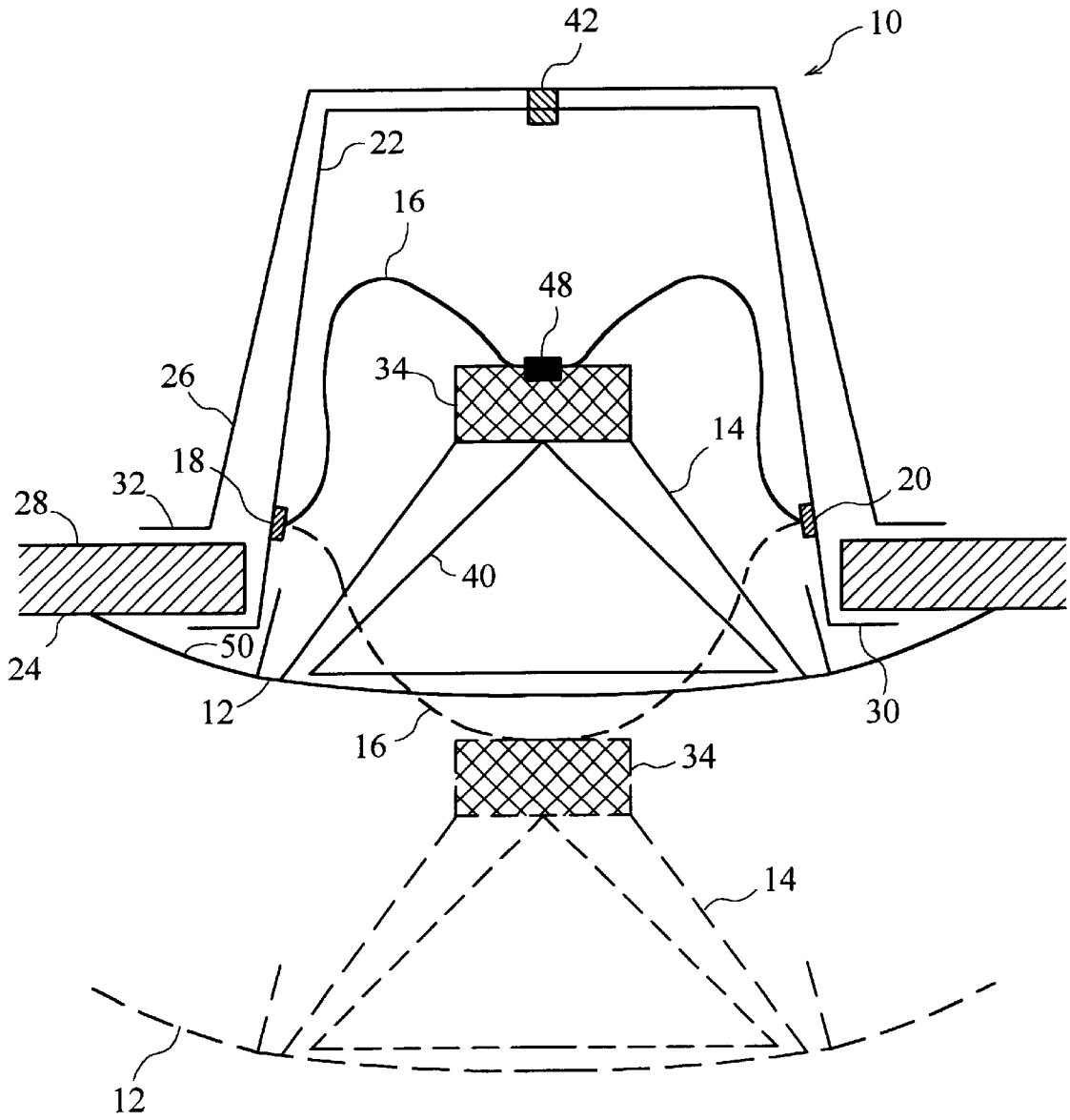
42
10
22
16
48
34
26
14
18
20
32
28
40
24
50
12
30
16
34
14
12

MOUNTING ARRANGEMENT FOR A LOUDSPEAKER, LUMINAIRE OR SIMILAR APPARATUS

BACKGROUND OF THE INVENTION

This invention relates to mounting arrangements for speakers or other apparatus which need to be recessed within walls or ceilings, for example, and yet need to be moved away from the plane of the wall or ceiling for maintenance or repair, etc.

In particular, in the construction of certain types of buildings it is often necessary to recess a large number of such objects in ceilings and walls, eg., speakers in an auditorium or theatre. Under such circumstances, it is desirable to minimise the expense involved with the labour and hardware devoted to the installation of such apparatus and its subsequent maintenance. A particularly desirable objection when the speakers are large and heavy is to ensure that such maintenance can be safely carried out in a relatively speedy manner.

Existing housing and or fixing means for recessed speakers or lamps, etc., exhibit inefficient design and/or employ attachment means involving various screw fasteners requiring awkward and time consuming assembly operations. An improvement to this prior art was provided by U.S. Pat. No. 5,143,339 which describes a spring-like mechanism which is nonetheless complicated and employs several components.

Alternative housings for loudspeakers require the fixing to be applied to the front of the apparatus, such as in Birkner et al. U.S. Pat. No. 3,859,480. This housing does not provide any improvement in the cost and time of maintenance of wall or ceiling-mounted loudspeakers which require access to the rear of the loudspeaker.

It is an object of at least the preferred embodiments of the present invention to further simplify the labour and reduce the cost of production, fitting and maintenance of mounting apparatus such as a lamp or loudspeaker, over the aforementioned prior art.

According to one aspect of the present invention, a mounting arrangement for a loudspeaker, luminaire or similar apparatus, comprises a housing in which the apparatus is received, and at least one resilient means attached to the housing and to the apparatus, the length of the resilient means between its points of attachment being such that when the apparatus is received in the housing the resilient means is deformed and exerts a force retaining the apparatus in the housing, withdrawal of the apparatus from the housing requiring further deformation of the resilient means through a state of greater deformation to a state in which it does not exert the retaining force.

According to another aspect of the present invention, a mounting arrangement for a loudspeaker, luminaire of similar apparatus, comprises a housing in which the apparatus is received and at least one resilient means attached to the housing and to the apparatus, the length of the resilient means between its points of attachment being such that when the apparatus is received in the housing the resilient means is deformed and exerts a force retaining the apparatus in the housing, withdrawal of the apparatus from the housing requiring further deformation of the resilient means through a state of greater deformation to a state of lesser deformation.

Preferably, the resilient means supports the apparatus when it is withdrawn from the housing.

The housing may further comprise a stop such that the apparatus is held against the stop by the resilient means when the apparatus is received into the housing.

Further, the length of the resilient means is such that when the apparatus is withdrawn the apparatus projects beyond the plane of said housing sufficiently for access of the rear of the apparatus for maintenance.

The resilient means may be attached to the apparatus that is to be received such that said no part of said mounting arrangement is visible when said apparatus is received into said housing.

Furthermore, there may be a plurality of such resilient means, preferably arranged such that the net force exerted by the resilient means is directed axially.

According to a preferred embodiment of the present invention, the resilient means is a spring or flexible strip, which may be deformed into a bowed or sinuous shape when the apparatus is in the housing.

In a preferred embodiment of the present invention, the housing forms a protective shell around the apparatus when the apparatus is received into the housing.

The housing may comprise an inner shell and an outer support structure held together by a fixing means.

The outer support structure may have a peripheral rim which abuts one side of the wall or ceiling panel and the inner shell may have a peripheral rim which abuts the exterior side of the ceiling panel thus forming a structure which isolates one side of the wall or ceiling panel from the other side thereof. This mounting arrangement thus maintains the integrity of the ceiling as a fire barrier, and also protects the speaker or lamp from dust present in the ceiling void.

The present invention will be understood more fully from the detailed description given hereinbelow and from the accompanying drawing, which are given by way of example only, and are not intended to limit the present invention.

BRIEF DESCRIPTION OF THE DRAWING

The drawing shows sectional views of a loudspeaker received into (represented by solid lines) and projecting out of (represented by dashed lines) a housing mounted on a ceiling panel according to a preferred embodiment of the present invention.

DETAILED DESCRIPTION OF THE INVENTION

The housing means 10 is recessed into an aperture 28 in the ceiling panel and consists of an inner shell 22 and a bracket 26. The shell is fixed in the aperture by fixing means, which comprise a peripheral rim 30 of the shell 22 and a flange 32 of the outer bracket 26, such that the ceiling panel is sandwiched between the peripheral rim and the flange. The housing shell 22 and outer support bracket 26 are held together by a nut, bolt or similar fixing means 42. The speaker is conventional and comprises a grill 12 exposed on the exterior of the ceiling panel which has a peripheral portion 50 which rests against the exterior side of the ceiling panel 24 when the speaker is received into the housing. The speaker grill 12 is fixed to a speaker frame 14. A speaker magnet 34 surrounds a voice coil which drives the speaker diaphragm or cone 40. A resilient means formed by a resiliently flexible strip 16 is attached to the back of the magnet 34 by fixing means 48 (for example, a rivet, keyhole fixing, spot weld or by a screw received in a tapped blind hole in the magnet). The flexible strip 16 is also attached to the shell 22 via fixing means, such as screws 18, 20.

The flexible strip 16 is of such stiffness and length and is disposed such that when the speaker is received into the housing 10, the flexible strip 16 is deformed (bent) in a bowed or sinuous shape and exerts an upward force on the speaker sufficient to retain it in the housing, supporting the speaker in a first state of equilibrium. Exerting a greater additional downward force on the speaker to withdraw it from the housing results in the flexible strip 16 being bent further and moving through a state of maximum deformation into a second state of equilibrium as the speaker is withdrawn from the housing 10. The length of the strip is such that both the rear of the speaker and the interior of can be easily inspected and or accessed. This second state of equilibrium is indicated in FIG. 1 by the dashed sketch of the flexible strip 16 and speaker components. The speaker is returned to the housing by the simple expedient of pushing it upwards against the spring force past the point of maximum deformation of the spring. The spring strip then pulls the speaker into the housing until its grill 12 abuts a stop formed by the exterior side of the ceiling panel.

The mounting arrangement provided by the present invention is thus easy to install and provides a relatively simple and straightforward mechanism to house speakers in a ceiling such that no part of the mounting arrangement is visible when the speaker is received into the housing. The flexible strip enables the speaker to be both speedily and safely withdrawn for maintenance, where it can be easily inspected, repaired or replaced as necessary.

The preferred embodiment of the present invention enables the housing means to be installed in the ceiling aperture and the speaker subsequently attached in situ. Moreover, the housing forms a shell which encapsulates the speaker when it is within the ceiling. This shell structure can thus provide a fire barrier and also an acoustic barrier, and can be utilised to load the loudspeaker eg. if provided with a facing of suitable acoustically absorbent material.

It should be noted that it is possible to attach the strip to the frame of the speaker and not to the magnet itself and still accomplish the advantages outlined above. Further, other resilient structures may be utilised as the resilient means, which is not limited to attachment at only two points on the housing. For example, the resilient means could be a mesh or resilient membrane attached at its perimeter to the housing shell and at a central point or points to the speaker. Alternatively, a plurality of resilient means may be arranged in a spider formation such that each resilient means is attached at only one point to said housing and is otherwise attached to said apparatus. Instead of a resilient strip, at least two coil springs could be employed, the stability of each spring about its axis if necessary being maintained by a telescopic rod passing through it and pivotally attached at its ends to the loudspeaker and the housing. The springs must be arranged so that their net force is axial at the speaker, i.e., radial forces must be balanced.

It can be seen that the mounting apparatus in accordance with the present invention exhibits many substantial advantages over the prior art both in terms of the complexity of the initial installation and subsequent maintenance. While a preferred embodiment of the present invention has been described using specific terms and, in particular, refers to the apparatus to be housed as a speaker to be mounted on a ceiling panel, such a description is for illustrative purposes only, and it is to be understood that changes and variations may be made without departing from the scope of the claims.

Each feature disclosed in this specification (which term includes the claims) and/or shown in the accompanying drawing may be incorporated in the invention independently of other disclosed and/or illustrated features.

The text of the abstract filed herewith is repeated here as part of the specification:

A mounting arrangement for a loudspeaker, luminaire or similar apparatus, comprising a housing in which the apparatus is received and at least one resilient means attached to the housing and to the apparatus, the length of the resilient means between its points of attachment being such that when the apparatus is received in the housing the resilient means is deformed and exerts a force retaining the apparatus in the housing, withdrawal of the apparatus from the housing requiring further deformation of the resilient means through a state of maximum deformation to a state of lesser deformation.

What is claimed is:

1. In combination: a loudspeaker, luminaire or similar apparatus; a housing in which the apparatus is received; and at least one resilient structure attached at respective spaced-apart points along the length of the resilient structure to the housing and to the apparatus, the length of the resilient structure between said points of attachment thereof and to the housing and the apparatus being such that when the apparatus is received in the housing the resilient structure is deformed and exerts a force retaining the apparatus in the housing, withdrawal of the apparatus from the housing requiring further deformation of the resilient structure through a state of greater deformation to a state in which the resilient structure does not exert the retaining force, the resilient structure remaining attached to the housing and to the apparatus when the apparatus is withdrawn from the housing.

2. A combination according to claim 1, wherein when the apparatus has been withdrawn from the housing, the resilient structure is in a state of lesser deformation.

3. A combination according to claim 1, wherein the resilient structure supports the apparatus when the apparatus is withdrawn from the housing.

4. A combination according to claim 1, further comprising a stop such that said apparatus is held against said stop by said resilient structure when the apparatus is received into said housing.

5. A combination according to claim 1, wherein when the apparatus is withdrawn from the housing the apparatus projects beyond the plane of said housing sufficiently for access of the rear of the apparatus for maintenance.

6. A combination according to claim 1, wherein the resilient structure is attached to the apparatus such that no part of said resilient structure is visible when said apparatus is received into said housing.

7. A combination according to claim 1, wherein said resilient structure is a flexible strip.

8. A combination according to claim 1, wherein the housing forms a protective shell around the apparatus when the apparatus is received into said housing.

9. A mounting arrangement for a loudspeaker, luminaire or similar apparatus, comprising a housing for receiving the apparatus, and at least one resilient structure attached to the housing and for attachment to the apparatus, the length of the resilient structure between the points of attachment thereof to the housing and to the apparatus being such that when the apparatus is received in the housing the resilient structure is deformed and exerts a force retaining the apparatus in the housing, withdrawal of the apparatus from the housing requiring further deformation of the resilient structure through a state of greater deformation to a state in which it does not exert the retaining force, the resilient structure remaining attached to the housing and to the apparatus when the apparatus is withdrawn from the housing.

10. A mounting arrangement according to claim 9, wherein when the apparatus has been withdrawn from the housing, the resilient structure is in a state of lesser deformation.

11. A mounting arrangement according to claim 9, wherein the resilient structure is adapted to support the apparatus when the apparatus is withdrawn from the housing.

12. A mounting arrangement according to claim 9, further comprising a stop for holding the apparatus against said stop by said resilient structure when the apparatus is received into said housing.

13. A mounting arrangement according to claim 9, wherein when the apparatus is withdrawn from the housing the apparatus projects beyond the front of said housing sufficiently for access of the rear of the apparatus for maintenance.

14. A mounting arrangement according to claim 9, wherein the resilient structure is adapted for attachment to the apparatus such that no part of said mounting arrangement is visible when the apparatus is received into said housing.

15. A mounting arrangement according to claim 9, wherein said resilient structure is a flexible strip.

16. A mounting arrangement according to claim 9, wherein the housing forms a protective shell around the apparatus when the apparatus is received into said housing.

17. In combination: a loudspeaker, luminaire or similar apparatus; a housing in which the apparatus is received; and at least one resilient structure attached at respective spaced-apart points along the length of the resilient structure to the housing and to the apparatus, the length of the resilient structure between the points of attachment thereof and to the housing and the apparatus being such that when the apparatus is received in the housing the resilient structure is deformed and exerts a force retaining the apparatus in the housing, withdrawal of the apparatus from the housing requiring further deformation of the resilient structure through a state of greater deformation to a state in which the resilient structure does not exert the retaining force, said resilient structure being a flexible strip which is deformed into a bowed or sinuous shape when the apparatus is in the housing.

18. A mounting arrangement for a loudspeaker, luminaire or similar apparatus, comprising a housing for receiving the apparatus, and at least one resilient structure attached to the housing and for attachment to the apparatus, the length of the resilient structure between the points of attachment thereof to the housing and to the apparatus being such that when the apparatus is received in the housing the resilient structure is deformed and exerts a force retaining the apparatus in the housing, withdrawal of the apparatus from the housing requiring further deformation of the resilient structure through a state of greater deformation to a state in which it does not exert the retaining force, the resilient structure being a flexible strip which is deformed into a bowed or sinuous shape when the apparatus is in the housing.

19. In combination: a loudspeaker, luminaire or similar apparatus; a housing in which the apparatus is received, the housing comprising an inner shell and an outer support structure held together by a fixing; and at least one resilient structure attached at respective spaced-apart points along the length of the resilient structure to the housing and to the apparatus, the length of the resilient structure between said points of attachment thereof and to the housing and the apparatus being such that when the apparatus is received in the housing the resilient structure is deformed and exerts a force retaining the apparatus in the housing, withdrawal of the apparatus from the housing requiring further deformation of the resilient structure through a state of greater deformation to a state in which the resilient structure does not exert the retaining force.

20. A mounting arrangement for a loudspeaker, luminaire or similar apparatus, comprising a housing for receiving the apparatus, the housing comprising an inner shell and an outer support structure held together by a fixing, and at least one resilient structure attached to the housing and for attachment to the apparatus, the length of the resilient structure between the points of attachment thereof to the housing and to the apparatus being such that when the apparatus is received in the housing the resilient structure is deformed and exerts a force retaining the apparatus in the housing, withdrawal of the apparatus from the housing requiring further deformation of the resilient structure through a state of greater deformation to a state in which it does not exert the retaining force.

* * * * *